United States Patent [19]

Wehler

[11] 4,233,895

[45] Nov. 18, 1980

[54] PRINTER COMPRISING A PRINTING HEAD WHICH IS ADJUSTABLE BY MEANS OF A MOTOR

[75] Inventor: Herbert Wehler, Neunkirchen-Salchendorf, Fed. Rep. of Germany

[73] Assignee: U.S. Philips Corporation, New York, N.Y.

[21] Appl. No.: 966,455

[22] Filed: Dec. 4, 1978

[30] Foreign Application Priority Data

Nov. 22, 1977 [DE] Fed. Rep. of Germany ..... 2752061

[51] Int. Cl.[3] ..... B41J 3/12; B41J 11/20; B41J 7/92

[52] U.S. Cl. ..... 101/93.05; 400/56; 400/57; 400/124

[58] Field of Search ..... 400/56, 57, 58, 59, 400/124, 121, 55; 101/93.04, 93.05; 74/53, 54, 56, 57, 569

[56] References Cited

U.S. PATENT DOCUMENTS

| | | | |
|---|---|---|---|
| 3,155,032 | 11/1964 | Antonucci | 400/58 X |
| 3,912,068 | 10/1975 | Kwan et al. | 400/56 X |
| 3,983,803 | 10/1976 | Thomas et al. | 400/56 X |
| 4,010,834 | 3/1977 | Linder | 400/56 |

FOREIGN PATENT DOCUMENTS

| | | | |
|---|---|---|---|
| 2162230 | 6/1973 | Fed. Rep. of Germany | 101/93.05 |

*Primary Examiner*—J. Reed Fisher
*Attorney, Agent, or Firm*—Robert S. Smith

[57] ABSTRACT

A printer comprising a carriage which is displaceable along a record carrier, parallel to the line direction, and on which a printing head is mounted which is displaceable transversely of the line direction by means of an electric motor. The electric motor is coupled to the printing head by means of two complementary cam discs and two cam followers. The electric motor is controlled by an electrical control signal which originates from a converter which is coupled to a sensor which contacts the record carrier.

2 Claims, 2 Drawing Figures

PRINTER COMPRISING A PRINTING HEAD WHICH IS ADJUSTABLE BY MEANS OF A MOTOR

The invention relates to a printer, comprising a carriage which is displaceable along a record carrier, parallel to the line direction, and on which there is arranged a printing head which is displaceable with respect to the carriage, in a direction transversely of the line direction, by means of a motor which is mounted on the carriage and which is coupled to the printing head.

In a known printer of the described kind (German patent application No. 2,162,230), the motor is coupled to the printing head by means of a gearwheel which has a flat side and which is capable of occupying a number of discrete positions. These positions correspond to a position of the printing head in which a record carrier can be introduced, and a position of the printing head which is to be occupied during printing. A drawback of the known printer consists in that during printing automatic adjustment of the position of the printing head as a function of the thickness of the record carrier is not possible. The thickness of the record carrier as well as the type of record carrier is liable to change during printing. For example, the thickness of one and the same record carrier is liable to vary viewed in the line direction, while it may also be necessary to print on two simultaneously present, laterally adjacent record carriers of different thickness.

The invention has for its object to provide a printer of the described kind in which the distance between the printing head and the record carrier can be adjusted during printing as a function of the thickness of the record carrier (carriers).

To this end, a printer in accordance with the invention is characterized in that the motor is coupled to the printing head by means of two complementary cam discs which are rigidly mounted on a drive shaft coupled to the motor and which are arranged between a first and a second cam follower, one cam disc bearing against the first cam follower connected to the printing head. The other cam disc bears against the second cam follower which is also connected to the printing head and which and which is situated at a substantially constant distance from the first cam follower, the motor being connected to a signal output of an electrical control device which comprises an electrical converter which is coupled to a sensor. The position of the sensor is dependent on the thickness of the record carrier. The converter produces a signal on the signal output of the control device for as long as the position of the printing head deviates from a given reference value.

Figure 1:
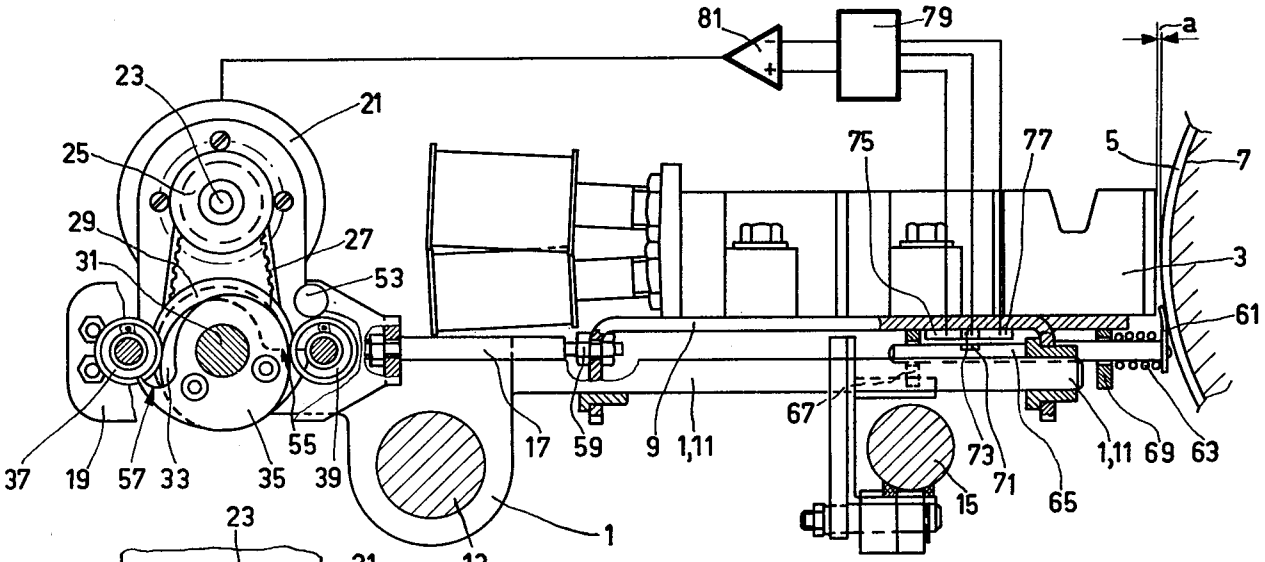
Figure 2:
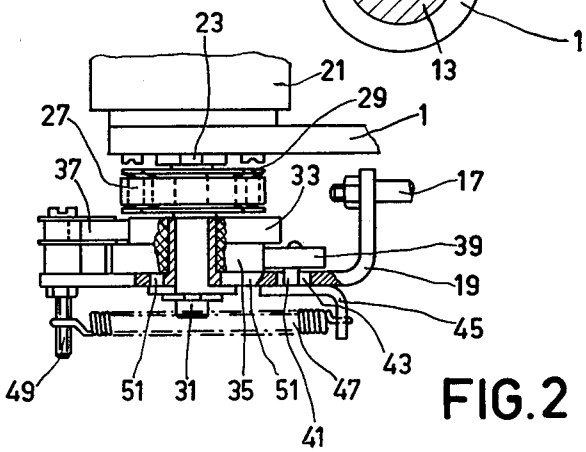

The invention will be described in detail hereinafter with reference to the accompanying diagrammatic drawing:

FIG. 1 is a side elevation in partial cross-sectional view of a preferred embodiment of a printer in accordance with the invention, and FIG. 2 is a plan view of the part of the printer shown in FIG. 1 which serves for driving the printing head.

The printer shown in FIG. 1 comprises a carriage 1 which is displaceable parallel to the line direction (perpendicularly to the plane of the drawing) and on which a printing head 3 is mounted. The printing head 3 is arranged opposite a record carrier 5 arranged on a platen 7. The printing head 3 comprises a number of recording pins (not shown for the sake of simplicity) which are electromagnetically driven and whose ends which are intended for printing are flush with the end of the printing head 3 facing the record carrier 5. The desired distance between the printing ends of the non-actuated recording pins and the record carrier 5 equals a (printing distance).

The printing head 3 is mounted on a support 9 which is displaceable, in a direction transverse to the line direction, along a shaft-like guide 11 which forms part of the carriage 1. In the line direction, the carriage 1 is guided along two bars 13 and 15. The support 9 is connected, by means of a coupling rod 17, to a sliding member 19 in the form of an L-shaped bracket (see FIG. 2). An electric motor 21 is rigidly mounted on the carriage 1. The motor 21 comprises a drive shaft 23 on which a first pulley 25 is mounted, said pulley being coupled, by way of a drive belt 27, to a second pulley 29 which is mounted on a driven shaft 31. The shaft 31 is journalled in the carriage 1 (not visible). A first cam disc 33 and a second cam disc 35 are mounted on the driven shaft 31. The first cam disc 33 bears against a roller-like first cam follower 37 which is rotatably journalled on the sliding member 19. The second cam disc 35 bears against a roller-like second cam follower 39. Contrary to the first cam follower 37, the second cam follower 39 is not only rotatable, but also slidable over a small distance with respect to the sliding member 19. To this end, the second cam follower 39 is rotatably journalled on a short shaft 41 which is inserted with clearance through an aperture 43 in the sliding member 19. The short shaft 41 is secured to an arm 45. One end of a tension spring 47 is secured to this arm 45, the other end of said spring being secured to a pin 49 connected to the sliding member 19. The tension spring 47 thus ensures that the two cam followers 37 and 39 bear against their respective cooperating cam discs 33 and 35. The pulling force of the tension spring 47 is sufficient to keep the printing head 3 in position during impact of the recording pins. Alternatively, the cam follower 39 could also be mounted to be rotatable but not slidable with respect to the sliding member 19. However, this implies that the manufacturing tolerances of the cam followers, cam discs and the relevent shafts and shaft journals must be very narrow. The driven shaft 31 is inserted with clearance through an aperture 51 in the sliding member 19, so that this shaft is not directly supported by the sliding member 19, but indirectly via the cam discs and cam followers (viewed in a radial direction). The sliding member 19 can thus perform a relative displacement with respect to the driven shaft 31.

The cam discs 33 and 35 are complementary, i.e. the distance between the cam discs 33 and 35 and the points of contact with the cam followers 37 and 39 is substantially constant. If the shaft 41 were not inserted through the sliding member 19 with some clearance, the distance between the points of contact would be completely constant. On the sliding member 19 there is arranged a pin-like abutment 53 which cooperates with two abutment faces 55 and 57 formed on the cam discs 33 and 35, respectively. The positions of the printing head 3 which correspond to the abutment faces 55 and 57 which contact the pin-like abutment 53 at different instants concern the position of the printing head 3 nearest to the platen 7 and the position of the printing head furthest from the platen 7. These positions can also be adjusted by means of the coupling rod 17 which can be effectively shortened or extended by turning a nut 59.

The electric motor 21 is controlled by a signal which is in principle derived from the displacement of a sensor 61 which is biased against the record carrier 5 by a pressure spring 63. The sensor 61 is mounted on a rod 65 which is guided in apertures in two ears 67 and 69 connected to the support 9. The spring 63 around the rod 65 is tensioned between the sensor 61 and the ear 69. The biasing force of the spring 64 is considerably lower than the pulling force of spring 47. The rod 65 comprises a piece of soft iron 71 which, in the case of the correct printing distance a for a record carrier of a defined thickness, is situated exactly opposite a permanent magnet 73 which is arranged between two magnetoresistors 75 and 77. The permanent magnet 73 and the magnetoresistors 75 and 77 form a unit which is mounted on the support 9 and which forms part of an electromagnetic/-mechanical converter which also includes the piece of soft iron 71. The magnetoresistors 75 and 77, connected to a voltage source (not shown), form part of a Wheatstone bridge which comprises two further resistors which have a fixed resistance (not visible in FIG. 1) and which are situated in a passive four-pole 79. The outputs of the passive four-pole 79 are connected to a differential amplifier 81. Said electromagnetic/mechanical converter, the four-pole 79 and the differential amplifier 81 together form an electrical control device, the output signal of which (the output signal of the differential amplifier 81) is applied to the electric motor 21. As soon as the sensor 61 is subjected to a displacement which is proportional to a variation of the thickness of the record carrier 5, a control signal whose amplitude is proportional to this thickness variation is applied to the electric motor 21, which displaces the printing head 3, via the cam discs 33 and 35, so that the piece of soft iron 71 is again positioned exactly opposite the permanent magnet 73. The printing distance a is thus maintained at a constant, desired value. Obviously, the converter which is arranged partly on the rod 65 (soft iron 71) and partly on the support 9 (magnetoresistors 75, 77 and the permanent magnet 73) can also be arranged in a different manner. For example, the rod 65 comprising the soft iron 71 can be guided on the carriage 1, whilst the magnetoresistors 75, 77 and the permanent magnet 73 are also mounted on the carriage.

Instead of a control system where the amplitude of the control signal is proportional to the variation of the thickness of the record carrier, obviously use can also be made of a control system supplying a control signal whose presence alone is decisive, rather than its value. The electric motor then continues to operate at a constant rotary speed until the control signal has disappeared. Furthermore, a variety of mechanical/electrical converters can be used such as, for example, mechanical/optical converters. Inductive mechanical-/electrical converters are also feasible. The described control system can also be used for so-termed electrostatic printers in which the writing electrodes contained in the printer must maintain a constant distance from the record carrier during the movement of the electrostatic printing head along the record carrier.

What is claimed is:

1. A printer for printing a plurality of characters along a line having a predetermined first direction on an associated record carrier which comprises:

a carriage which is displaceable along the record carrier in a direction which is parallel to said first direction, a printing head carried on said carriage, means for mounting said printing head on said carriage which allows said printing head to be displaced with respect to said carriage in a direction which is generally transverse to said first direction, said means for mounting including a motor which is mounted on said carriage, means for coupling said motor and said printing head, said means for coupling including first and second cam discs, and a drive shaft coupled to said motor, said first and second cam discs being rigidly mounted on said drive shaft, said means for coupling including first and second cam followers located at diametrically opposite sides of said drive shaft with respect to one another and respectively cooperating with said first and second cams, said first and second cams being of a configuration so that the axes of said first and second cam followers remain disposed at a substantially constant distance one from the other upon rotation of said drive shaft, said means for coupling including a slidable member one end of which is connected to said printing head, said first cam follower being rotatably journalled on the opposite end of said slidable member, said second cam follower being carried on a shaft, said follower shaft being mounted in an aperture in said slidable member with said aperture being dimensioned to provide clearance around said follower shaft, means connected to said slidable member for biasing said second cam follower toward said second cam, said apparatus including means for controlling the position of said printing head, said means for controlling cooperating with said motor and including means for producing a signal output for as long as the position of said printing head deviates from a predetermined reference value, said means for producing including a sensor, the position of said sensor being dependent on the thickness of the record carrier, said sensor producing the signal output of said means for controlling for as long as the position of said printing head deviates from a predetermined reference value.

2. A printer as claimed in claim 1 further including means for adjusting the distance between said slidable member and said printing head.

* * * * *